US006317390B1

(12) United States Patent
Cardoza

(10) Patent No.: US 6,317,390 B1
(45) Date of Patent: Nov. 13, 2001

(54) TIME MEDICATION CONTAINER

(76) Inventor: Andrew Cardoza, 31A Rattray Road, Brixton, London, SW2 1BA (GB)

( * ) Notice: Subject to any disclaimer, the term of this patent is extended or adjusted under 35 U.S.C. 154(b) by 0 days.

(21) Appl. No.: 09/480,524

(22) Filed: Jan. 7, 2000

(51) Int. Cl.[7] ..... G04B 47/00

(52) U.S. Cl. ..... 368/10; 368/107; 368/108; 368/109; 368/278; 221/2

(58) Field of Search ..... 368/10, 89, 107–109, 368/278; 221/2–3, 15; 215/219, 220, 40; 206/533, 534, 535

(56) References Cited

U.S. PATENT DOCUMENTS

| | | | | |
|---|---|---|---|---|
| D. 295,024 | | 4/1988 | Trick . | |
| 493,851 | | 3/1893 | Adsit . | |
| 3,033,355 | | 5/1962 | Van Sickle . | |
| 4,069,935 | * | 1/1978 | Hampel | 215/219 |
| 4,347,804 | * | 9/1982 | Villa-Real | 368/89 |
| 4,367,955 | * | 1/1983 | Ballew | 368/10 |
| 4,419,016 | | 12/1983 | Zoltan . | |
| 4,504,153 | * | 3/1985 | Scholllmeyer et al. | 221/2 |
| 4,753,189 | * | 6/1988 | Mastman et al. | 206/534 |
| 4,782,966 | * | 11/1988 | Thackrey | 215/219 |
| 4,939,705 | * | 7/1990 | Hamilton et al. | 368/10 |
| 5,016,230 | * | 5/1991 | Seifers et al. | 368/10 |
| 5,020,037 | | 5/1991 | Raven . | |
| 5,233,571 | * | 8/1993 | Wirtschafter | 368/10 |
| 5,313,439 | | 5/1994 | Albeck . | |
| 5,370,251 | * | 12/1994 | Buono | 215/220 |
| 5,625,334 | * | 4/1997 | Compton | 368/10 |
| 5,751,661 | * | 5/1998 | Walters | 368/10 |
| 5,815,586 | * | 9/1998 | Dobbins | 215/273 |
| 5,893,473 | * | 4/1999 | Morris, Sr. | 215/220 |
| 5,990,782 | * | 11/1999 | Lee | 368/10 |
| 6,084,504 | * | 7/2000 | Rosche et al. | 368/89 |
| 6,194,995 | * | 2/2001 | Gates | 221/2 |

* cited by examiner

*Primary Examiner*—Andrew H. Hirshfeld
*Assistant Examiner*—Jeanne-Marguerite Goodwin

(57) ABSTRACT

A timed medication container for sounding an alarm when medication needs to be taken. The timed medication container includes a bottle for housing medication. A cap for removably closing the bottle has a top wall. The top wall has a top surface. Control circuitry is fixedly mounted in the top wall of the cap. The control circuitry is adapted for tracking elapsing time, subtraction, and activation of an alarm. The control circuitry comprises a microprocessor. A display displays information from the control circuitry. The display is mounted on the control circuitry. A surface of the display is generally flush with the top surface of the top wall. The display is operationally coupled to the control circuitry. A plurality of bores is in the top wall of the cap. A button for programming the control circuitry is in each of the bores in the cap. Each of the buttons is fixedly coupled to the control circuitry.

5 Claims, 3 Drawing Sheets

TIME MEDICATION CONTAINER

BACKGROUND OF THE INVENTION

1. Field of the Invention

The present invention relates to medication alarms and more particularly pertains to a new timed medication container for sounding an alarm when medication needs to be taken.

2. Description of the Prior Art

The use of medication alarms is known in the prior art. More specifically, medication alarms heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,313,439; U.S. Pat. No. 5,020,037; U.S. Pat. No. 4,419,016; U.S. Pat. Des. No. 295,024; U.S. Pat. No. 3,033,355; and U.S. Pat. Des. No. 493,85 1.

While these devices fulfill their respective, particular objectives and requirements, the aforementioned patents do not disclose a new timed medication container. The inventive device includes a bottle for housing medication. A cap for removably closing the bottle has a top wall. The top wall has a top surface. Control circuitry is fixedly mounted in the top wall of the cap. The control circuitry is adapted for tracking elapsing time, subtraction, and activation of an alarm. The control circuitry comprises a microprocessor. A display displays information from the control circuitry. The display is mounted on the control circuitry. A surface of the display is generally flush with the top surface of the top wall. The display is operationally coupled to the control circuitry. A plurality of bores is in the top wall of the cap. A button for programming the control circuitry is in each of the bores in the cap. Each of the buttons is fixedly coupled to the control circuitry.

In these respects, the timed medication container according to the present invention substantially departs from the conventional concepts and designs of the prior art, and in so doing provides an apparatus primarily developed for the purpose of sounding an alarm when medication needs to be taken.

SUMMARY OF THE INVENTION

In view of the foregoing disadvantages inherent in the known types of medication alarms now present in the prior art, the present invention provides a new timed medication container construction wherein the same can be utilized for sounding an alarm when medication needs to be taken.

The general purpose of the present invention, which will be described subsequently in greater detail, is to provide a new timed medication container apparatus and method which has many of the advantages of the medication alarms mentioned heretofore and many novel features that result in a new timed medication container which is not anticipated, rendered obvious, suggested, or even implied by any of the prior art medication alarms, either alone or in any combination thereof.

To attain this, the present invention generally comprises a bottle for housing medication. A cap for removably closing the bottle has a top wall. The top wall has a top surface. Control circuitry is fixedly mounted in the top wall of the cap. The control circuitry is adapted for tracking elapsing time, subtraction, and activation of an alarm. The control circuitry comprises a microprocessor. A display displays information from the control circuitry. The display is mounted on the control circuitry. A surface of the display is generally flush with the top surface of the top wall. The display is operationally coupled to the control circuitry. A plurality of bores is in the top wall of the cap. A button for programming the control circuitry is in each of the bores in the cap. Each of the buttons is fixedly coupled to the control circuitry.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new timed medication container apparatus and method which has many of the advantages of the medication alarms mentioned heretofore and many novel features that result in a new timed medication container which is not anticipated, rendered obvious, suggested, or even implied by any of the prior art medication alarms, either alone or in any combination thereof.

It is another object of the present invention to provide a new timed medication container which may be easily and efficiently manufactured and marketed.

It is a further object of the present invention to provide a new timed medication container which is of a durable and reliable construction.

An even further object of the present invention is to provide a new timed medication container which is susceptible of a low cost of manufacture with regard to both materials and labor, and which accordingly is then susceptible of low prices of sale to the consuming public, thereby making such timed medication container economically available to the buying public.

Still yet another object of the present invention is to provide a new timed medication container which provides in the apparatuses and methods of the prior art some of the advantages thereof, while simultaneously overcoming some of the disadvantages normally associated therewith.

Still another object of the present invention is to provide a new timed medication container for sounding an alarm when medication needs to be taken.

Yet another object of the present invention is to provide a new timed medication container which includes a bottle for housing medication. A cap for removably closing the bottle has a top wall. The top wall has a top surface. Control circuitry is fixedly mounted in the top wall of the cap. The control circuitry is adapted for tracking elapsing time, subtraction, and activation of an alarm. The control circuitry comprises a microprocessor. A display displays information from the control circuitry. The display is mounted on the control circuitry. A surface of the display is generally flush with the top surface of the top wall. The display is operationally coupled to the control circuitry. A plurality of bores is in the top wall of the cap. A button for programming the control circuitry is in each of the bores in the cap. Each of the buttons is fixedly coupled to the control circuitry.

Still yet another object of the present invention is to provide a new timed medication container that contains a contact so that the microprocessor knows when the bottle has been opened.

Even still another object of the present invention is to provide a new timed medication container that can be adapted to keep a record of all dosages and when they were taken.

Yet another object of the present invention is to provide a new timed medication container that will tell a user when medication was last taken.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
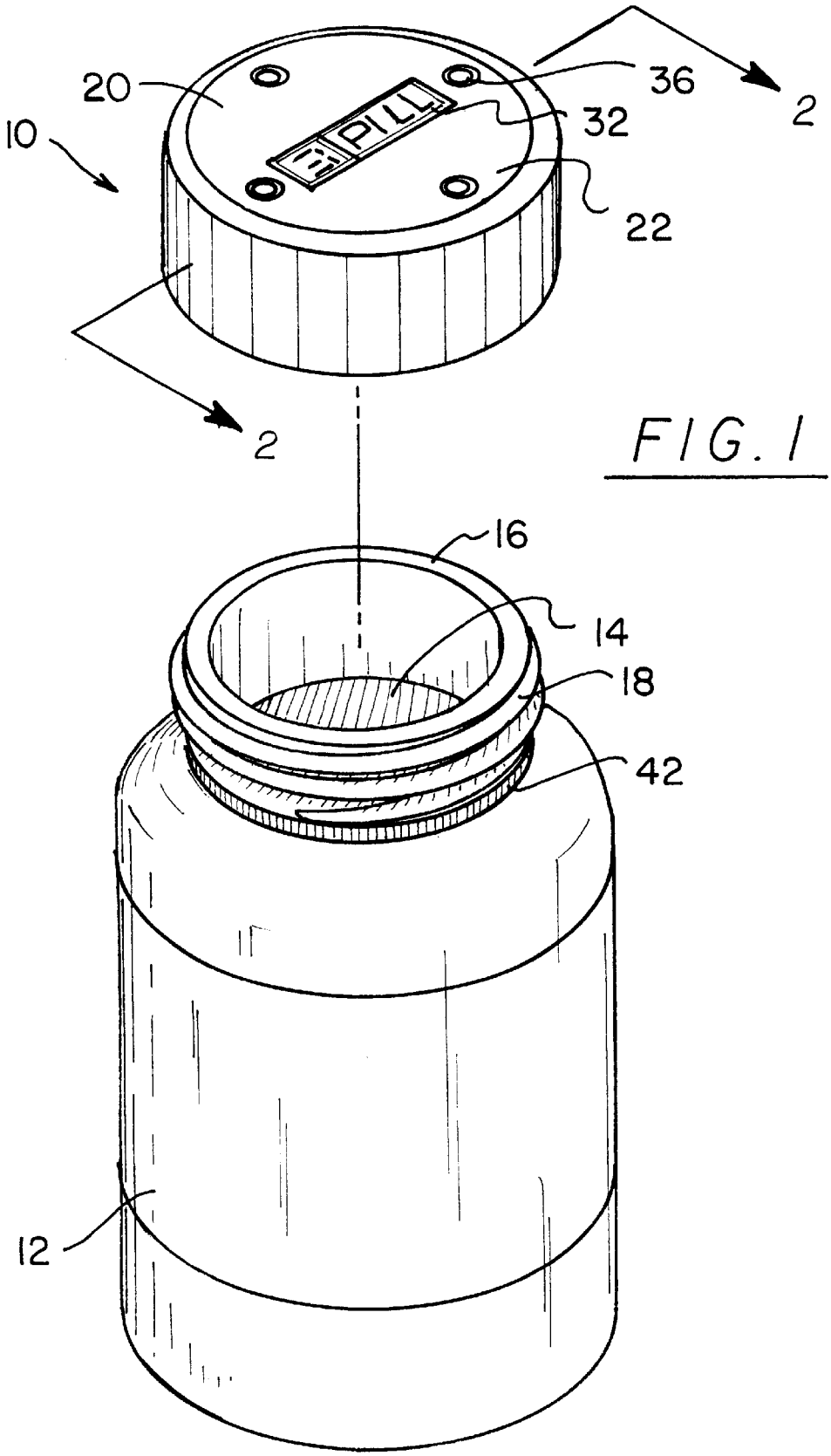
FIG. 1 is a schematic perspective view of a new timed medication container according to the present invention.
Figure 2:
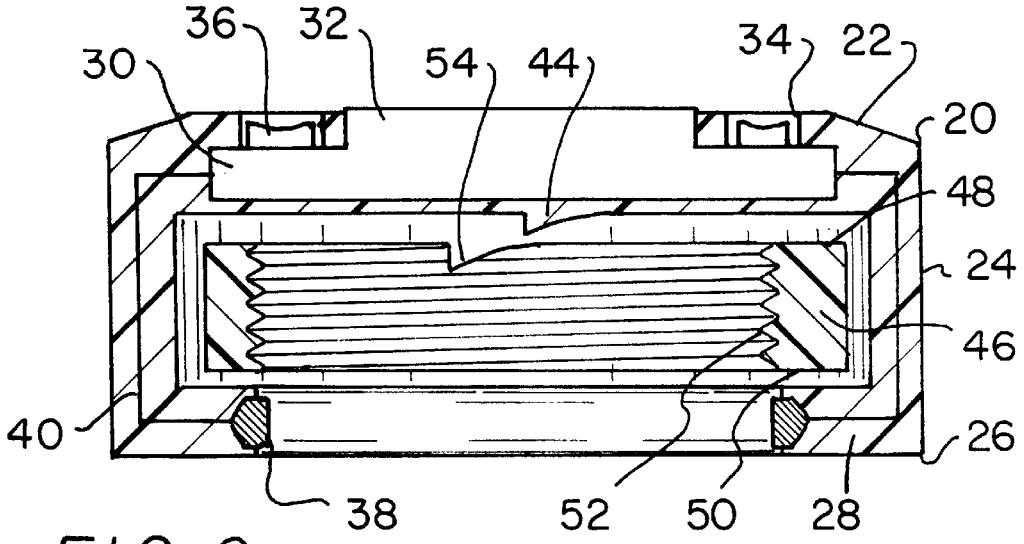
FIG. 2 is a schematic cross-sectional view taken along line 2—2 of the cap of the present invention.
Figure 3:
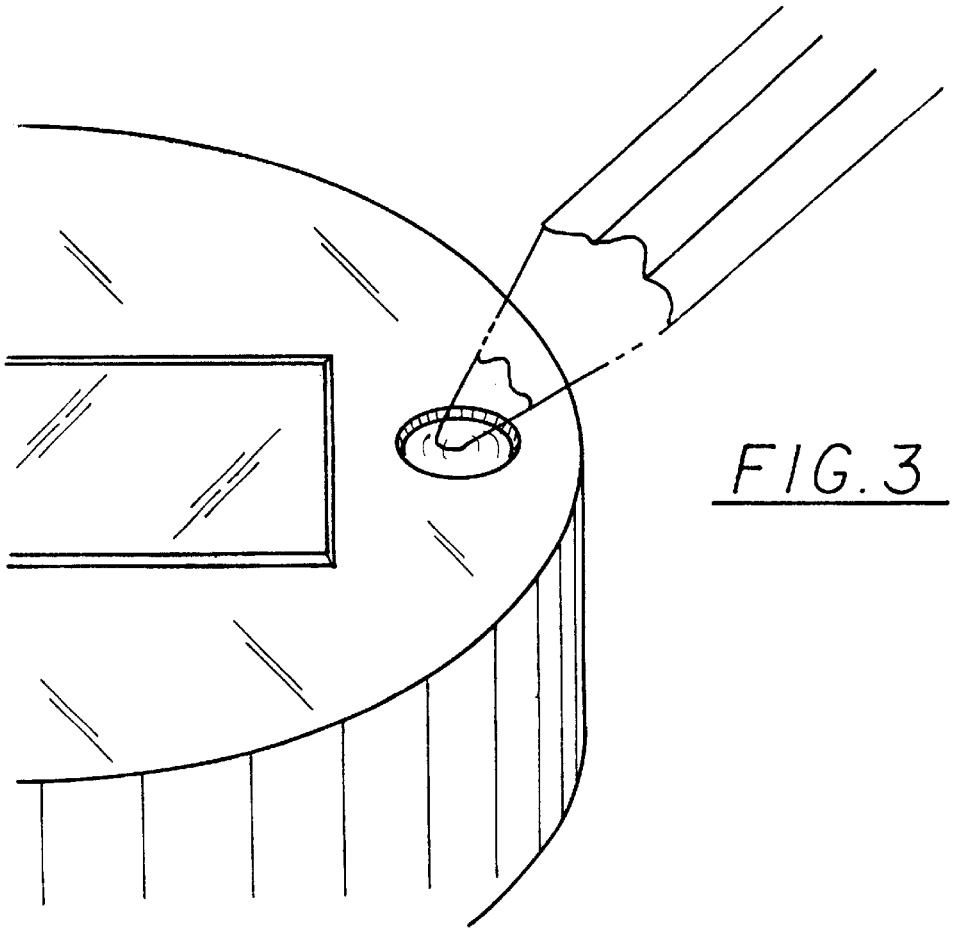
FIG. 3 is a schematic perspective view of the buttons of the present invention.
Figure 4:
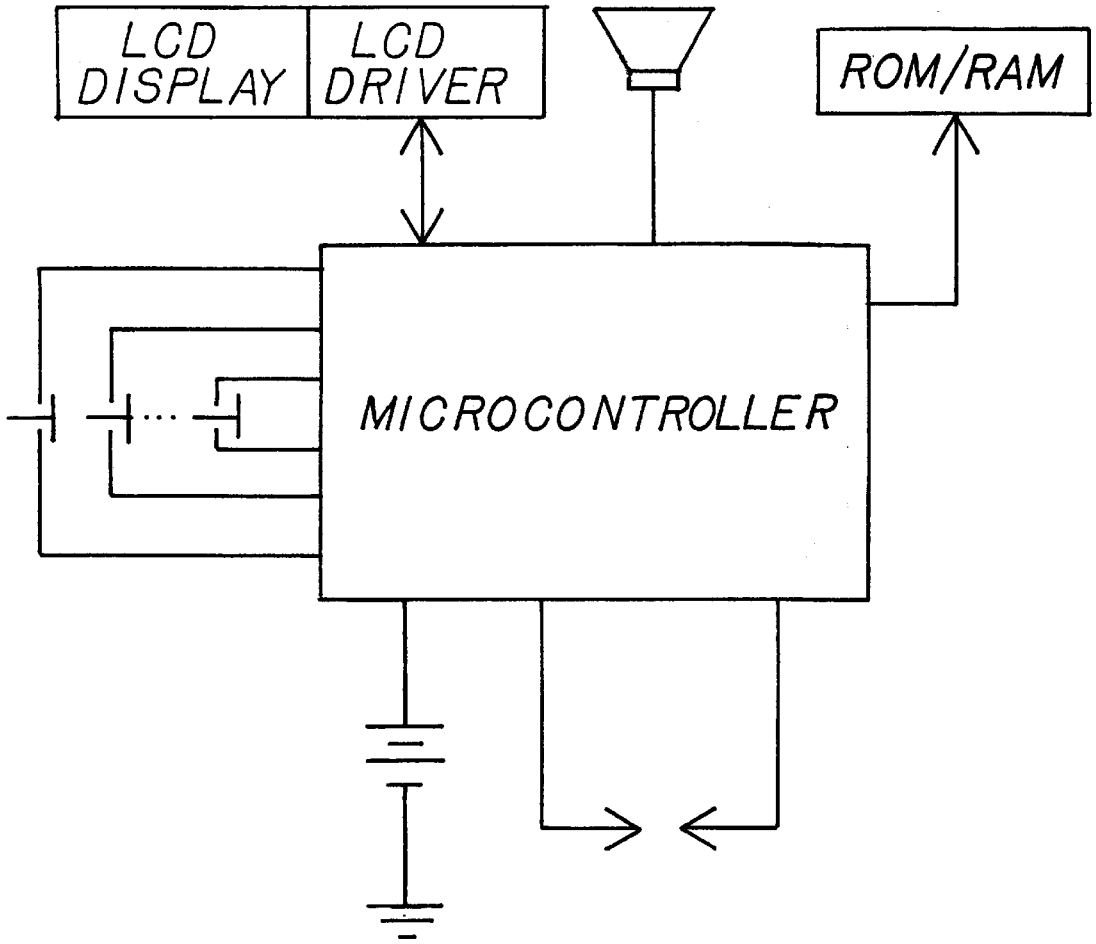
FIG. 4 is an electrical schematic of the present invention.

With reference now to the drawings, and in particular to FIGS. 1 through 4 thereof, a new timed medication container embodying the principles and concepts of the present invention and generally designated by the reference numeral 10 will be described.

As best illustrated in FIGS. 1 through 4, the timed medication container 10 generally comprises a bottle 12 for housing medication. The bottle 12 has an open end 14 having a lip 16 thereon. The lip 16 is annular and has threads 18 formed thereon.

A cap 20 for removably closing the bottle has a top wall 22 and a side wall 24 with a bottom edge 26. The top wall 22 has a top surface and a generally circular shape. The bottom edge 26 is generally annular and preferably has an annular flange 28 thereon. The flange 28 extends radially inward.

Control circuitry 30 is fixedly mounted in the top wall 22 of the cap 20. The control circuitry 30 is adapted for tracking elapsing time, subtraction, and activation of an alarm. The control circuitry 30 comprises a microprocessor.

A display 32 displays information from the control circuitry 30. The display 32 is mounted on the control circuitry 30. A surface of the display 32 is preferably flush with the top surface of the top wall 22. The display 32 is operationally coupled to the control circuitry 30. Ideally, the display 32 comprises a liquid crystal display.

Four bores 34 are in the top wall 22 of the cap 20. Each of the bores 34 is generally located adjacent to the side wall 24.

Four buttons 36 program the control circuitry 30. One of the buttons 36 is in each of the bores 34 in the cap 20. Each of the buttons 36 is fixedly coupled to the control circuitry 30.

A pair of contacts 38 is fixedly mounted on the annular flange 28. The contacts 38 are generally diametrically opposed. Each of the contacts 38 has a wire 40 connected thereto, which is operationally coupled to the control circuitry 30. The wires 40 are mounted the annular flange 28, the side wall 24 and the top wall 22 of the cap 20.

A conductive strip 42 completes an electrical connection between the pair of contacts 38. The conductive strip 42 is generally annular and extends about the open end of the bottle 12. The conductive strip 42 is at a juncture of the lip 16 and the open end 14 of the bottle 12. The conductive strip 42 is made from a conductive material.

A ridge 44 extends away from an inside surface of the top wall 22.

A safety device prevents accidental opening of the bottle. The safety device is a tube 46 having a top edge 48 and a bottom edge 50. The tube 46 is hollow. An exterior diameter of the tube 46 is greater than an inner diameter of the annular flange 28 such that the tube 46 is held in the cap 20 between the annular flange 28 and the top wall 22. The inner surface of the tube has threads 52 thereon for coupling to the threads 18 on the lip 16 of the bottle 12. The top edge 48 of the tube has a notch 54 therein. In use, the cap 20 is pressed toward the bottle 12 and turned such that the ridge 44 catches the notch 54 allowing the safety device to rotate with respect to the bottle 12.

In use, medication is inserted into the bottle 12. The control circuitry 30 is programmed to display when the next dose is to be taken and how large of a dose is required. The control circuitry 30 will sound an alarm if the time has passed to take the medication. The circuit will break when the cap is removed and the contacts 38 are no longer touching the conductive strip 42. This allows the microprocessor to "know" that the bottle has been opened and the medication taken. The microprocessor will also keep a tally of the amount of dosages remaining and sound an alarm when a refill is required. The microprocessor can be powered by a small battery, not shown.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A timed medication container for tracking dosages and times of medication use, said timed medication container comprising:

a bottle for housing the medication;

a cap for removably closing said bottle, said cap having a top wall, said top wall having a top surface, and said cap having a side wall, said side wall having an annular flange; and control circuitry being fixedly mounted in said top wall of said cap, said control circuitry being adapted for tracking elapsing time, subtraction, and activation of an alarm, said control circuitry comprising a microprocessor;

a display for displaying information from said control circuitry, said display being mounted on said control circuitry, said display being operationally coupled to said control circuitry;

a plurality of bores, each of said bores being in said top wall of said cap;

a plurality of buttons for programming said control circuitry, one of said buttons being in each of said bores in said cap, each of said buttons being fixedly coupled to said control circuitry;

a pair of contacts, said contacts each being fixedly mounted on said annular flange, said contacts being generally diametrically opposed, each of said contacts having a wire connected thereto, each of said wires being operationally coupled to said control circuitry, each of said wires being mounted on said annular flange, said side wall and said top wall of said cap; and a conductive strip for completing an electrical connection between said pair of contacts, said conductive strip being generally annular and extending in a continuous manner about the open end of said bottle such that said diametrically opposed pair of contacts are abuttable against said strip at all rotational positions of said cap, said conductive strip being at a juncture of a lip of said bottle and said open end of said bottle, said conductive strip being made from a conductive material.

2. A timed medication container as in claim 1, wherein said lip is annular and has threads formed thereon.

3. A timed medication container as in claim 1, wherein said display comprises a liquid crystal display.

4. A timed medication container as in claim 1, further comprising:

a ridge, said ridge extending away from an inside surface of said top wall;

a safety device for preventing accidental opening of said bottle, said safety device being a tube, said tube having a top edge and a bottom edge, said tube being hollow, an exterior diameter of said tube being greater than an inner diameter of said annular flange such that said tube is held in said cap between said annular flange and said top wall, an inner surface of said tube having threads thereon for coupling to threads on said lip of said bottle, said top edge of said tube having a notch therein, wherein said cap is pressed toward said bottle and turned such that said ridge catches said notch allowing said safety device to rotate with respect to said bottle.

5. A timed medication container for tracking dosages and times of medication use, said timed medication container comprising:

a bottle for housing the medication, said bottle having an open end, said open end having a lip thereon, said lip being annular, said lip having threads formed thereon;

a cap for removably closing said bottle, said cap having a top wall and a side wall with a bottom edge, said top wall having a top surface, said top wall having a generally circular shape, said bottom edge being generally annular, said bottom edge having an annular flange thereon, said flange extending radially inward;

control circuitry being fixedly mounted in said top wall of said cap, said control circuitry being adapted for tracking elapsing time, subtraction, and activation of an alarm, said control circuitry comprising a microprocessor;

a display for displaying information from said control circuitry, said display being mounted on said control circuitry, a surface of said display being generally flush with said top surface of said top wall, said display being operationally coupled to said control circuitry, wherein said display comprises a liquid crystal display;

four bores, said bores being in said top wall of said cap, each of said bores being generally located adjacent to said side wall;

four buttons for programming said control circuitry, one of said buttons being in each of said bores in said cap, each of said buttons being fixedly coupled to said control circuitry;

a pair of contacts, said contacts each being fixedly mounted on said annular flange, said contacts being generally diametrically opposed, each of said contacts having a wire connected thereto, each of said wires being operationally coupled to said control circuitry, each of said wires being mounted on said annular flange, said side wall and said top wall of said cap;

a conductive strip for completing an electrical connection between said pair of contacts, said conductive strip being generally annular and extending in a continuous manner about the open end of said bottle such that said diametrically opposed pair of contacts are abuttable against said strip at all rotational positions of said cap, said conductive strip being at a juncture of said lip and said open end of said bottle, said conductive strip being made from a conductive material;

a ridge, said ridge extending away from an inside surface of said top wall;

a safety device for preventing accidental opening of said bottle, said safety device being a tube, said tube having a top edge and a bottom edge, said tube being hollow, an exterior diameter of said tube being greater than an inner diameter of said annular flange such that said tube is held in said cap between said annular flange and said top wall, an inner surface of said tube having threads thereon for coupling to said threads on said lip of said bottle, said top edge of said tube having a notch therein, wherein said cap is pressed toward said bottle and turned such that said ridge catches said notch allowing said safety device to rotate with respect to said bottle.

* * * * *